United States Patent [19]

Maloney et al.

[11] Patent Number: 4,485,892

[45] Date of Patent: Dec. 4, 1984

[54] PLATFORM STOOL

[75] Inventors: Kevin Maloney; Charles E. Schroer, both of Columbus, Ind.

[73] Assignee: Cosco, Inc., Columbus, Ind.

[21] Appl. No.: 517,458

[22] Filed: Jul. 26, 1983

[51] Int. Cl.[3] ..... E06C 1/383; E06C 1/387

[52] U.S. Cl. ..... 182/161; 182/162

[58] Field of Search ..... 182/156, 159, 161, 162, 182/125, 126, 116

[56] References Cited

U.S. PATENT DOCUMENTS

| | | | |
|---|---|---|---|
| 579,328 | 3/1897 | McConnell | 182/161 |
| 2,207,923 | 7/1940 | Kelso | 182/156 |
| 2,280,691 | 4/1942 | Edelmann | 182/161 |
| 2,596,521 | 5/1952 | Bell | 182/156 |
| 2,857,087 | 10/1958 | Pratt | 182/156 |
| 2,975,856 | 3/1961 | Anderson | 182/161 |
| 3,127,953 | 4/1964 | Shore | 182/156 |
| 3,303,906 | 2/1967 | Bouwmeester | 182/161 |

*Primary Examiner*—Reinaldo P. Machado
*Attorney, Agent, or Firm*—Barnes & Thornburg

[57] ABSTRACT

A step stool has a top step that is foldable alongside a next lower step to form a large platform. The platform stool has a pair of hinged frame assemblies that are laterally spaced apart to embrace a plurality of uniformly ascending elevated steps disposed therebetween. A first step and a second step situated above the first step are journaled for pivotal movement to the frame assemblies. A pair of laterally spaced-apart step linkages support the first and second elevated steps. A third elevated step is supported between the frame assemblies. A pair of laterally spaced-apart platform linkages support the third elevated step in either a top position above the second step or a lower position alongside the second step. A pair of platform brackets can be mounted on the rear legs substantially adjacent to the second elevated step. The stool can further include a pair of latch assemblies. Receptacles can be provided in the frame assembly hinges and platform brackets to receive each latch assembly so that the third step is lockable in either the top or lower position. The fully extended platform stool is collapsible to permit the steps to fold flat within the folded frame assemblies.

12 Claims, 8 Drawing Figures

PLATFORM STOOL

This invention relates to step stools, and particularly to a platform step stool having a top step movable alongside an adjacent lower step to provide a platform.

Conventional step stools include a plurality of ascending steps rigidly fixed within a hinged frame. Such step stools may be collapsible, and typically they include a top step of approximately the same size as the other ascending steps. A user perched on the top or other upper step is susceptible to serious injury in the event of a fall. The risk of a fall is substantially increased in the case of a conventional step stool due to the small step area on which a user may stand.

Non-collapsible step stools having a large top step adapted to provide a platform surface are also known. This type of step stool typically includes a plurality of steps rigidly fixed within an unhinged frame. Such a step stool is limited in mobility and utility due to its fixed structure. Further, step stools of that type do not permit an increase in elevation above the platform without exposing the user to serious injury. Unfortunately, users often risk serious injury by placing an overturned pail or other similar article on the platform to provide an additional step.

The present invention provides a step stool that has a movable top step which folds alongside a lower second step to form a large platform. Illustratively, the stool includes at least three steps. Further, the platform step stool is fully collapsible. A unique linkage supporting the movable top step enables a user to fold the platform step stool into a substantially flat mobile unit. A platform step stool embodying the present invention is outfitted with several compatible lock mechanisms to protect the safety of a user on the top step as well as the platform. The lock mechanisms are adapted to permit movability of the top step and collapsability of the stool itself.

In accordance with the present invention, a platform stool includes a step frame having a pair of hinged frame assemblies. Each frame assembly includes a front and rear leg. The frame assemblies are laterally spaced apart to embrace a plurality of uniformly ascending elevated steps disposed therebetween. The stool includes two or more elevated steps. A first step and a second step situated above the first step are journaled for pivotal movement to the frame assemblies. A third elevated step is received between the hinged frame assemblies. The fully extended platform stool is collapsible to permit the steps to fold flat within the folded frame assemblies.

The platform stool further includes first linkage means for supporting the first and second elevated steps. The first linkage means can include a pair of laterally spaced-apart step linkages. Each step linkage includes a first step link pivotally mounted to each of the first and second steps and a second step link pivotally mounted to the second step and one of the rear legs.

Additionally, the platform stool includes second linkage means for supporting the third elevated step in either a top position or a lower position alongside the second step. The second and third steps cooperate to form a platform when the third step is fixed in its lower position. The second linkage means can include a pair of laterally spaced-apart platform linkages. Each platform linkage includes first and second platform links pivotally coupled to the second and third elevated steps in spaced parallel relationship to provide a parallelogram linkage assembly. The second linkage means can also include two platform latch brackets and latch means for latching the third step in either the top or the lower position. One platform latch bracket can be mounted to each rear leg adjacent to the pivotally mounted second step link.

According to the illustrative embodiment, the latch means includes a pair of latch assemblies. Each latch assembly a spring-biased latch member coupled to the first platform link to retractably engage either one of the hinges or one of the platform latch brackets.

The platform stool can include locking means for reinforcing the second platform links so that the third elevated step is connected to the rear legs. The locking means can include two opposing lock brackets. One lock bracket can be mounted to each rear leg between the platform latch bracket and the hinged frame joint.

A keeper is disposed within the lock bracket. In the illustrative embodiment, each second platform link has an aperture situated to receive the slidable keeper. Thus, each keeper is movable to optionally fix the second platform links to the rear legs to reinforceably support the third elevated step in the first position above the second elevated step.

The invention can best be understood by referring to the following description and accompanying drawings which illustrate a preferred embodiment exemplifying the best mode of carrying out the invention as presently perceived. In the drawings.

Figure 1:
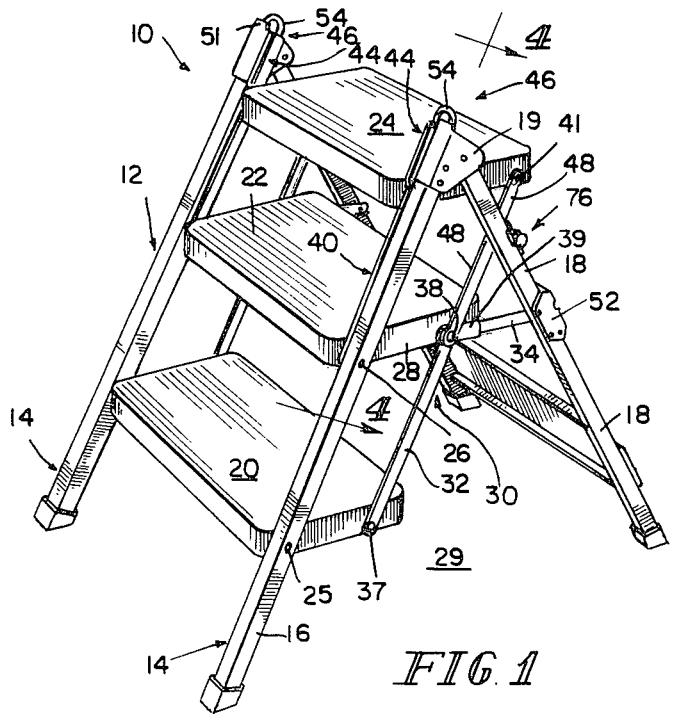
FIG. 1 is an isometric view of an uncollapsed platform stool of the present invention showing the top elevated step in a first position above the next lower elevated step.

A platform stool 10 embodying the present invention provides a portable set of ascending steps having a hinged frame 12 for steadying. The frame 12 includes a pair of laterally spaced-apart frame assemblies 14. Each frame assembly 14 includes a front leg 16 is hinged to a rear leg 18 by a hinge 19 so that the legs 16, 18 may be folded together to collapse the frame 12.

Figure 4:
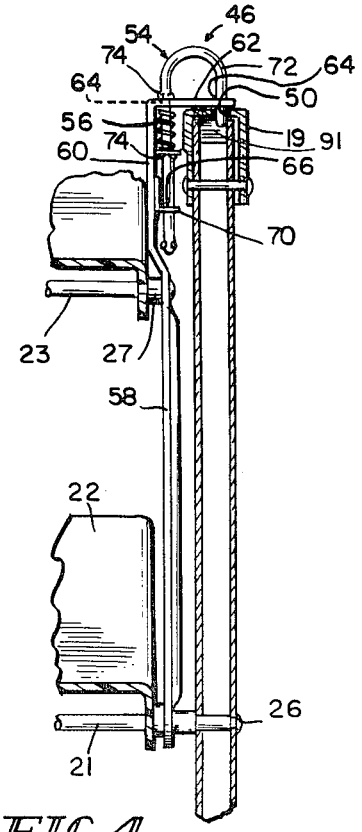
FIG. 4 is an enlarged sectional detail view, partly broken away and cross-sectioned, of the invention taken generally along line 4—4 of FIG. 1.
Figure 2:
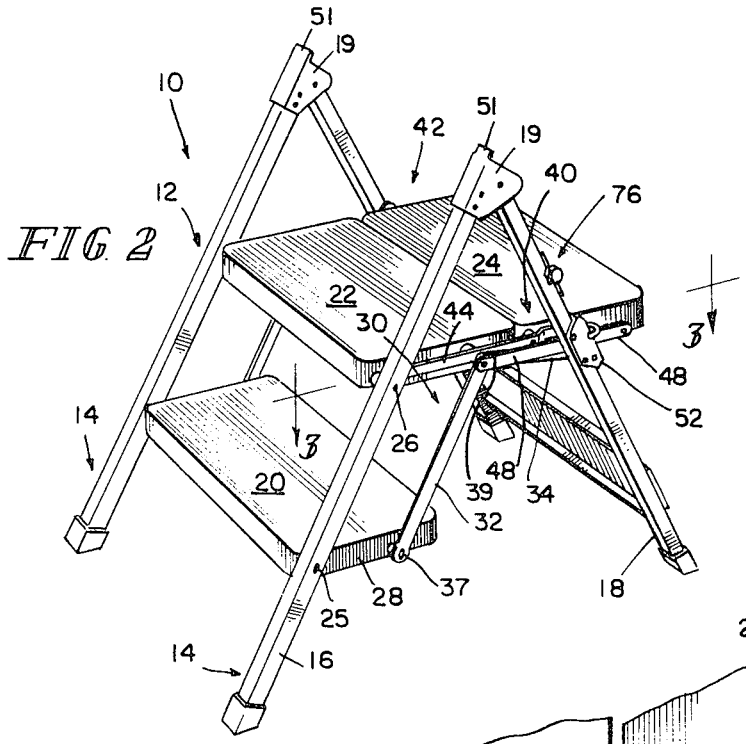
FIG. 2 is an isometric view of the invention showing the top elevated step in a second position alongside the next lower elevated step to form a platform.
Figure 3:
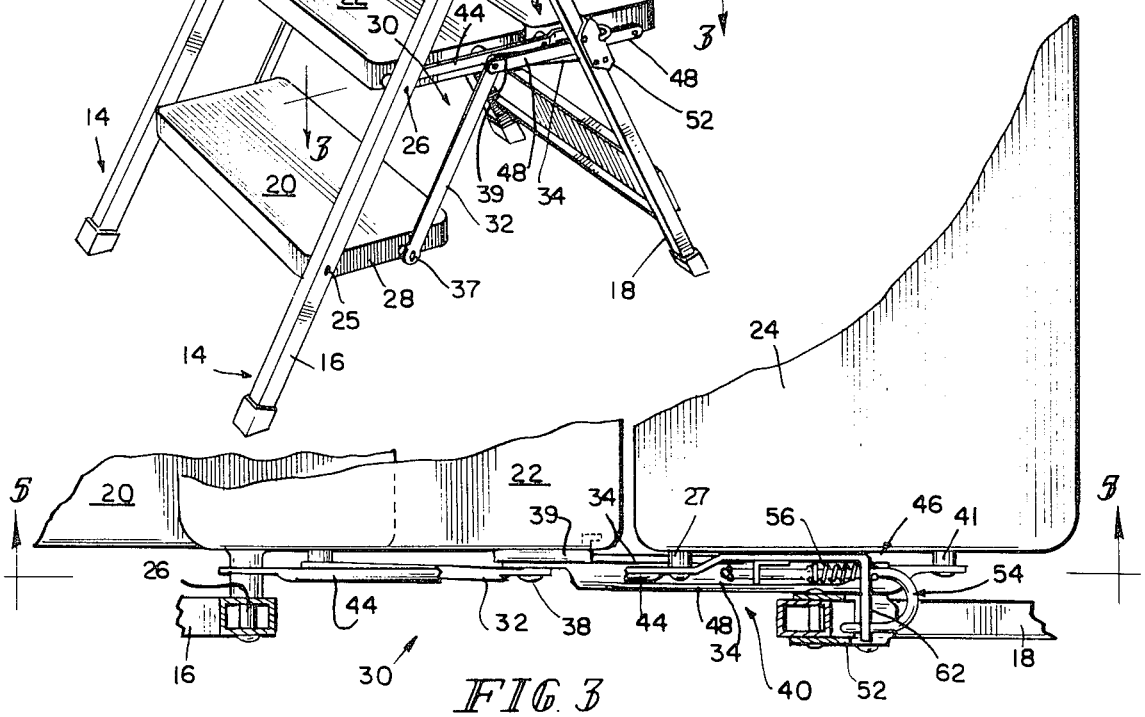
FIG. 3 is an enlarged sectional detail view, partly broken away, of the invention taken generally along line 3—3 of FIG. 2.

The frame assemblies 14 are spaced apart to receive elevated steps therebetween. In the illustrative embodiment, the stool 10 includes a first elevated step 20, a second elvated step 22, and a movable third (top) elevated step 24. The steps may be molded from a plastic material. A first wire pivot rod (not shown) is attached along the length of first step 20, as shown in FIGS. 1, 2, and 4, to provide a first pair of oppositely extending step pins 25. Likewise, a second wire pivot rod 21 is attached along the length of second step 22 to provide a second pair of oppositely extending step pins 26. Each of step pins 25, 26 is mounted to one of the shorter side panels 28 that are transverse to the length of the first and second steps 20, 22, as shown in FIGS. 1–3. The pair of step pins 25, 26 extend longitudinally of the steps 20, 22. The first and second steps 20, 22 are journaled through step pins 25, 26, respectively, to the front legs 16 so that the first or bottom step 20 is elevated a first distance above an underlying surface 29 and the second step 22 is elevated a second greater distance above the surface 29. A third wire pivot rod 23 is attached along the length of the third (top) step 24 to provide a third pair of oppositely extending step pins 27.

The platform stool 10 further includes a pair of laterally spaced-apart first linkages 30 to rigidly support the first and second steps 20, 22 in a service position (see FIGS. 1 and 2). In addition, the first linkages 30 are articulated to both steps 20, 22 and the rear legs 18 to guide smoothly the steps 20, 22 to a folded position (see FIG. 7) as the frame 12 is collapsed.

Each first linkage 30 includes two narrow lightweight metal step links. A first step link 32 has one end pivotally coupled to one of the first step side panels 28 and the other end pivotally coupled to the substantially coplanar second step side panel 28. The first step link 32 lies in spaced parallel relationship to the adjacent front leg 16 as shown in FIGS. 1 and 2. A second step link 34 has one end pivotally coupled to the second step side panel 28 and the other end pivotally coupled to one of two rear leg pins 36. Each rear leg pin 36 (see FIG. 5) is fixed to an inwardly facing wall (not shown) of one of the rear legs 18. The substantially coaxial rear leg pins 36 extend inwardly toward one another from the laterally spaced-apart rear legs 18 to lie in a confronting relationship. In the illustrative embodiment, the first step link 32 is coupled to the first step 20 by a first linkage pin 37, and the first and second step links 32, 34 are coupled by a second linkage pin 38 to the second step 22 to pivot about the same axis, as shown in FIGS. 1, 2, and 3.

A spreader lock 39 has one end pivotally mounted to second linkage pin 38 and the other end attached to the second step side panel 28 in close proximity to a rearward edge of the second step 22. The spreader lock 39 has a downwardly opening flange (not shown) to receive the second step link 34 of the uncollapsed stool 10 to limit the movement of the second step 22 as the stool 10 is unfolded. Thus, the spreader lock 39 helps to support the steps 20, 22, and 24 in a substantially horizontal position.

The platform stool 10 further includes a pair of laterally spaced-apart parallelogram (second) linkages 40 to rigidly support the third or top elevated step 24 in a service position adjacent the apex of the hinged frame 12, as shown best in FIG. 1. In addition, the second linkages 40 are articulated to both of the second and third elevated steps 22, 24 in spaced parallel relationship forming a parallelogram linkage assembly. The second linkages 40 permit the third elevated step 24 to be moved from the service position above the second elevated step 22 to a second position alongside the second elevated step 22 to form a platform 42 therewith as best shown in FIG. 2. The second linkages 40 also smoothly guide the third step 24 to a folded position (see FIG. 7) as the frame 12 is collapsed.

Each second linkage 40 includes a first platform link 44 adapted to provide a latch means 46 for optionally locking the third elevated step 24 in either the upper step position or the lower platform position, and a second platform link 48 to reinforceably support the third step 24 in either of the two above-mentioned positions. To latch the third elevated step 24 in the two third step positions, each hinge 19 includes a latch-receiving aperture, as shown generally at 50, and a hinge tab 51. Further, each rear leg 18 is provided with a platform latch-receiving bracket 52 mounted adjacent one of the rear leg pins 36. The latch means 46 includes a pair of latch assemblies mounted on respective opposite frame assemblies 14 of the frame 12. Each latch assembly includes a hook-shaped latch member 54 and a spring 56 for biasing or urging the latch member toward the couplings between the latch link 44 and steps 22 and 24.

As shown in FIG. 4, the first platform link 44 is a narrow substantially L-shaped member having a long connecting portion 58 and an inwardly offset bent latching portion 60. The distal end of the connecting portion 58 is pivotally coupled to the second step 22 on one of the step pins 26. A portion of the first platform link intermediate the connecting portion 58 and the bent latching portion 60 is pivotally coupled to the third step 24 on one of the step pins 27. The first platform links 44 are substantially parallel to the front legs 16 when the third step 24 is locked in its service position. Also, the first platform links 44 are pivotable about the second pair of step pins 26 and the third pair of step pins 27 to rest in a substantially horizontal position when the third step 24 is locked in its lower platform position.

Each bent latching portion 60 provides a receptacle for the spring-loaded latch member 54 to permit the latch member 54 to engage either the aperture 50 in the hinge 19 or the platform latch bracket 52. The bent latching portion 60 includes a flange 62 provided with two spaced apertures 64. The bent latching portion 60 also carries a small guide flange 66 situated adjacent to the flange 62, as shown in FIG. 4. The guide flange 66 is provided with an aperture (not shown) coaxially aligned with one of the flange apertures 64 closest to the bend 68 in the bent latching portion 60.

The latch member 54 includes a rod portion 70 received in the aligned flange and guide flange apertures and an integral hook portion 72 received in the outer flange aperture 64. The latch member 54 is yieldably biased by spring 56 so that the hook portion 72 is normally received in the outer flange aperture 64. The spring 56 slidably embraces only the rod portion 70 of the latch memer 54 and is captured between the flange 62 and guide flange 66 by two spaced pinched segments 74 formed on the rod, as shown best in FIG. 4. Thus, the latch member 54 is spring-loaded, enabling locked engagement with the aperture 50 of hinge 19 so that the third step 24 is releasably lockable in the first position above the second elevated step 22, shown in FIG. 1. Also, the latch wire member 54 is retractable to permit the first and second platform links 44 and 48, respectively, to pivot into a position permitting the latch member 54 to lockably engage the platform bracket 52. Thus, the third step 24 is releasably lockable in the second position alongside the second elevated step 22 to form a platform 42 therewith.

Each second platform link 48 has one end pivotally coupled to the second step 22 on one of the second linkage pins 38. The other end of each second platform link 48 is coupled to the third step 24 by third linkage pins 41, as best shown in FIG. 1.

Figure 6:
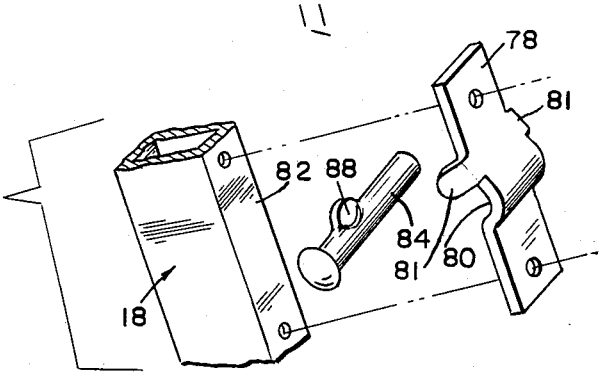
FIG. 6 is an exploded view of a lock assembly of the platform stool embodying the present invention.

The stool 10 further includes a pair of lock assemblies 76 fixed on each of the frame assemblies 14 for selectably reinforcing the load-bearing second platform links 48. Each lock assembly 76 includes a bracket 78 shaped to provide a passage or channel 80. Each bracket 78 is mounted rearwardly facing side panel 82 of one of the rear legs 18 as shown in FIGS. 1, 2, and 6. Each bracket has two retention skirts 81 for retaining a keeper 84 and limiting its extent of travel in channel 80. Each bracket 78 is securely mounted to one of the rear legs 18 so as to transversely fix the channel 80 on the side panels 82.

Figure 5:
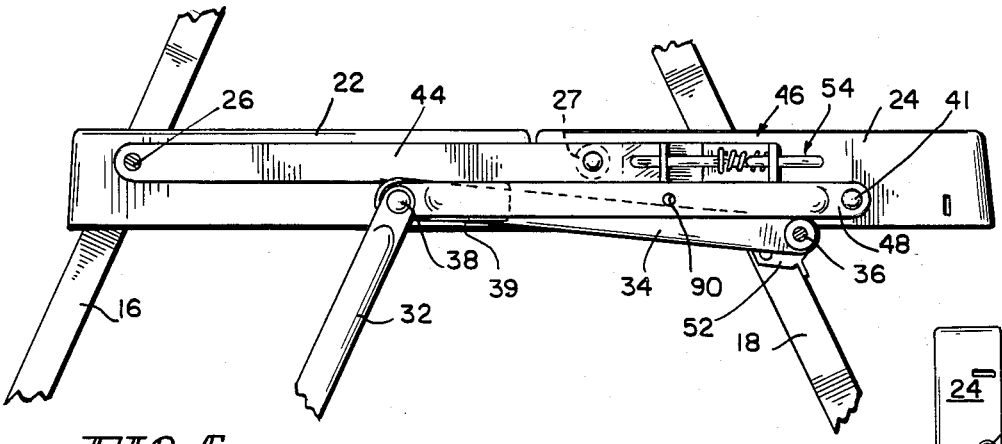
FIG. 5 is a sectional detail view, partly broken away and cross-sectioned, of the invention taken generally along line 5—5 of FIG. 3.

A keeper 84 is receivable within the channel 80 to engage an aperture 90 formed in a central portion of each second platform link 48 (FIG. 5). In the illustrative embodiment, the keeper 84 is a round head pin and includes a lug 88 that extends radially beyond the diameter of the pin. The keeper 84 is assembled within the bracket 78 by first placing the lug-carrying portion of the pin parallel to the panel 82 of leg 18 and subsequently attaching the bracket 78 to the rear leg 18 so that the bracket channel 80 is transverse to the side panel 82. The keeper 84 may be manually reciprocated in the channel 80. The keeper 84 can penetrate the aperture 90, but is prevented from falling out of the channel 80. The keeper 84 reinforceably supports the third elevated step 24 in the service position above the second elevated step 22.

Figure 7:
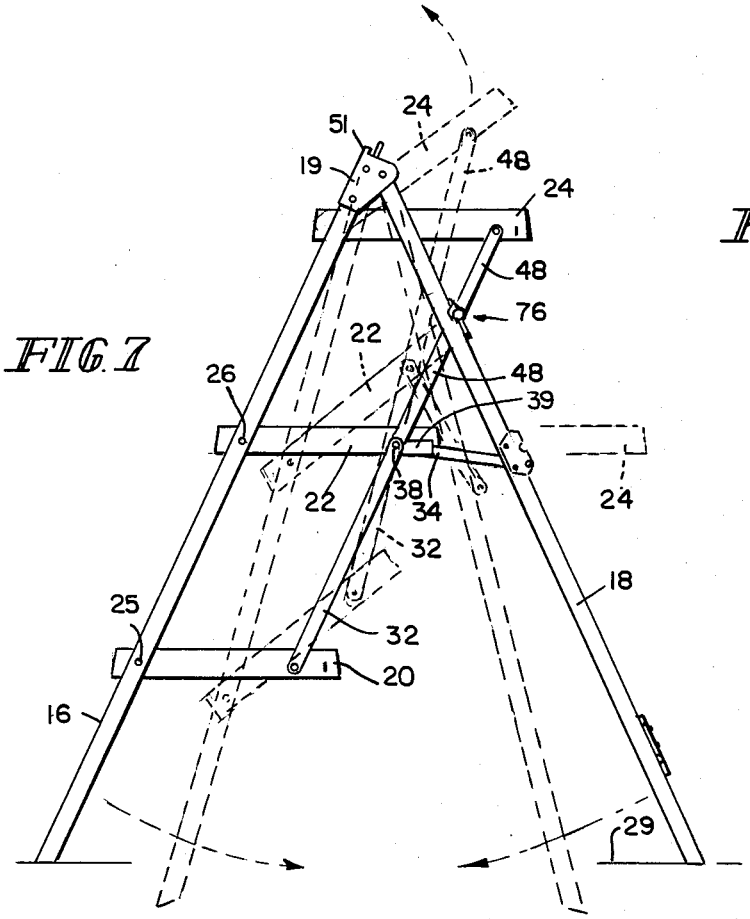
FIG. 7 is a side elevation of the invention showing the orientation of parts of the stool as it is collapsed from the position shown in FIG. 1 to a flat-fold position.
Figure 8:
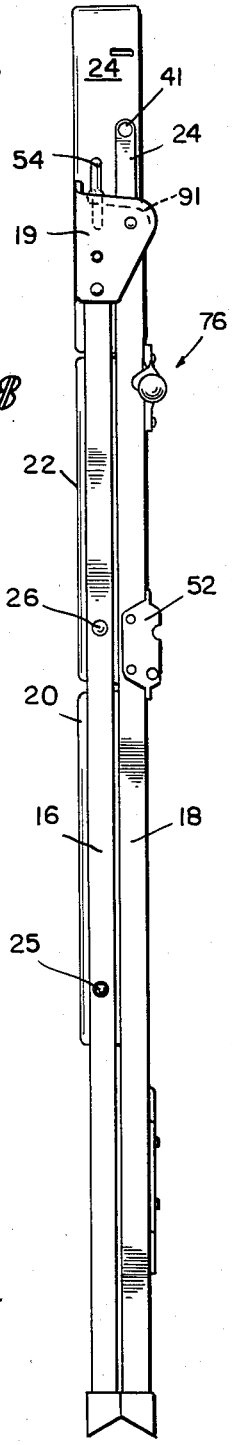
FIG. 8 is a side elevation of the fully collapsed stool.

The fully extended platform stool 10 is collapsible to permit the steps 20, 22, and 24 to fold flat within the folded frame assemblies 14 as shown in FIGS. 7 and 8. The stool is collapsible by lifting the stool a short distance above the underlying surface and pivoting the front and rear legs 16, 18 toward one another about hinge 19.

In its service position (shown in FIG. 1), lock mechanisms 76 must be released by the user before the stool 10 may be collapsed. The keeper 84 of each laterally spaced-apart lock assembly 76 is reciprocated in a manner already described in its channels to uncouple the second platform link 48 and the rear leg 18 of each frame assembly 14, thus to permit pivotable movement of the second platform links 48 about linkage pins 38. Latch mechanism 46 can remain latched to hinge 19 when collapsing the stool 10 while in its service position.

When the stool 10 is in its platform position (shown in FIG. 2), both laterally spaced-apart latch members 54 of latch means 46 must be released from engagement with the platform latch bracket 52. Disengagement is accomplished by simultaneously retracting both hook portions 72 from biased positions within the latch bracket 52. The amount of force necessary to retract the hook portions 72 is funtionally related to the spring constant of each of the biasing springs 56. Once the latch mechanism 46 is released and the third step 29 moved to its service position, the stool is collapsible from a fully extended position (solid lines) to an intermediate folding position (broken lines) as shown in FIG. 7. As the top step 24 is moved to its latched service position (FIG. 1), hook portions 72 ramp along camming surfaces 91 to seat in apertures 50 of hinges 19. Hinge tabs 51 are provided to prevent override of the latch mechanism 46. As the front and rear legs 16, 18 are pivoted toward one another, the journaled elevated steps 20, 22, and 24 are pivoted by the second linkage 40 in the manner already described. As shown in FIG. 7, the parallelogram shape of the second linkage 40 varies and keeps the steps in parallel relationship as the stool 10 is collapsed.

The fully collapsed stool 10 is illustrated in FIG. 8. Although all of the illustrated steps 20, 22, and 24 are embraced between the folded frame assemblies 14, the top elevated step 24 partially extends above the apex of the stool 10. The stool 10 is collapsible when the movable top step 24 is placed in its upper position as shown by the solid line drawing in FIG. 7. The movable top step 24 is unable to unexpectedly swing to a position other than the position shown in FIG. 8 due to the limited movability of the second step link 34. Thus, the collapsed platform step stool 10 is easily transported.

Although the invention has been described in detail with reference to certain preferred embodiments and specific examples, variations and modifications exist within the scope and spirit of the invention as described and as defined in the following claims.

What is claimed is:

1. A platform stool comprising a pair of collapsible frame assemblies, each frame assembly including a front leg and a rear leg hingedly coupled to each other, the frame assemblies being laterally spaced apart to receive elevated steps therebetween, a lower elevated step journaled for pivotal movement to each of the front legs, an upper elevated step supported between the frame assemblies, the upper elevated step having a first position above the lower elevated step and a second position alongside the lower elevated step to form a platform therewith, first linkage means for collapsibly supporting the lower elevated step, and second linkage means for collapsibly supporting the upper elevated step in its first and second positions.

2. The stool of claim 1 wherein the second linkage means incudes a laterally spaced-apart pair of parallelogram linkages, means for coupling the parallelogram linkages to the frame assemblies, the lower elevated step, and the upper elevated step to cause the upper elevated step to remain in a plane substantially parallel to the plane of the lower elevated step as the upper elevated step is moved from its first to its second position and vice versa.

3. A platform stool comprising a pair of collapsible frame assemblies, each frame assembly including a front leg and a rear leg, leg coupling means for hingedly coupling the rear legs and the front legs, the frame assemblies being laterally spaced apart to receive a plurality of elevated steps therebetween, a first elevated step journaled for pivotal movement to each of the front legs, a second elevated step journaled for pivotal movement to each of the front legs and situated above the first elevated step, a third elevated step received between the frame assemblies, the third elevated step having a first position above the second elevated step and a second position alongside the second elevated step to form a platform therewith, first linkage means for collapsibly supporting the first and second elevated steps, and second linkage means for collapsibly supporting the third elevated step in its first and second position.

4. The stool of claim 3 wherein the second linkage means comprises a laterally spaced-apart pair of parallelogram linkages, means for coupling the parallelogram linkages to the frame assemblies, the second elevated step, and the third elevated step to cause the third elevated step to remain in a plane substantially parallel to the plane of the second elevated step as the third elevated step is moved from its first to its second position and vice versa.

5. The stool of claim 4 wherein each parallelogram linkage comprises a first and second platform link, and wherein the coupling means comprises first means for coupling one end of the first platform link to the frame assembly, second means for coupling the other end of the first platform link to the third elevated step, third means for coupling one end of the second platform link to the second elevated step, and fourth means for coupling the other end of the second platform step to the third elevated step.

6. The stool of claim 3 wherein the second linkage means includes a pair of laterally spaced-apart first platform links, each first link having one end pivotally mounted to the frame assembly and a portion in close proximity to the other end pivotally mounted to the third elevated step, and a pair of laterally spaced-apart second platform links, each second link having one end pivotally mounted to the second elevated step and the other end pivotally mounted to the third elevated step, and wherein the stool further comprises latch means for releasably locking the third elevated step in one of its first and second positions.

7. The stool of claim 6 wherein each frame assembly includes a latch-receiving platform bracket, each bracket being fixed to one of the rear legs, the leg coupling means includes latch-receiving apertures, and the latch means comprises a latch member coupled to the other of the ends of the first platform link to retractably engage one of the platform brackets and one of the latch-receiving apertures.

8. The stool of claim 3 further comprising lock means for locking the third elevated step in its first position, and means for mounting the lock means on the rear legs to engage the second platform links reinforceably support the third elevated step in its first position.

9. The stool of claim 3 wherein the first linkage means comprises a pair of laterally spaced-apart step linkages, each step linkage including a first step link having one end mounted for pivotal movement to the first elevated step and the other end mounted for pivotal movement to the second elevated step, and a second step link having one end mounted for pivotal movement to the second elevated step and the other end mounted for pivotal movement to one of the rear legs.

10. The stool of claim 4 wherein the first linkage means comprises a pair of laterally spaced-apart step linkages, each step linkage including a first step link having one end mounted for pivotal movement to the first elevated step and the other end mounted for pivotal movement to the second elevated step, and a second step link having one end mounted for pivotal movement to the second elevated step and the other end mounted for pivotal movement to one of the rear legs. The second platform links being laterally spaced apart to contact the rear leg pins to cause the third elevated step to be rigidly supported in its second position.

11. A stool comprising a frame, a plurality of steps mounted on said frame one above the other including at least an upper step and a lower step, and means for mounting said upper on said frame for movement between a position above said lower step and a position alongside the lower step to form a platform therewith on said frame.

12. The stool of claim 11 in which said frame includes a pair of collapsible frame assemblies laterally spaced apart for receiving the steps therebetween and said mounting means includes a laterally spaced-apart pair of parallelogram linkages for supporting the upper step in its two positions relative to the lower step.

* * * * *

UNITED STATES PATENT AND TRADEMARK OFFICE

CERTIFICATE OF CORRECTION

PATENT NO. : 4,485,892

DATED : December 4, 1984

INVENTOR(S) : Kevin Maloney and Charles E. Schroer

It is certified that error appears in the above-identified patent and that said Letters Patent is hereby corrected as shown below:

Column 2, line 9, after "assembly", insert --includes--.

Column 2, line 62, change "elvated" to --elevated--.

Column 4, line 54, before "shown", insert --as--.

Column 5, line 4, after "mounted", insert --to--.

Column 5, line 41, after "about", insert --second--.

Column 6, line 36 (claim 2), change "incudes" to --includes--.

Column 8, line 2 (claim 8), after "links" insert --to--.

Column 8, line 33 (claim 11), after "upper", insert --step--.

Signed and Sealed this

*Eighteenth* Day of *June 1985*

[SEAL]

*Attest:*

DONALD J. QUIGG

*Attesting Officer* *Acting Commissioner of Patents and Trademarks*